US007269879B2

(12) United States Patent
Kegg et al.

(10) Patent No.: US 7,269,879 B2
(45) Date of Patent: Sep. 18, 2007

(54) SOLUTION DISTRIBUTION ARRANGEMENT FOR A CLEANING MACHINE

(75) Inventors: Steven W. Kegg, Uniontown, OH (US); Donald A. Coates, Canton, OH (US)

(73) Assignee: The Hoover Company, North Canton, OH (US)

( * ) Notice: Subject to any disclaimer, the term of this patent is extended or adjusted under 35 U.S.C. 154(b) by 565 days.

(21) Appl. No.: 10/740,061

(22) Filed: Dec. 18, 2003

(65) Prior Publication Data

US 2005/0132523 A1 Jun. 23, 2005

(51) Int. Cl.
*A47L 11/30* (2006.01)

(52) U.S. Cl. ..... 15/320; 15/321

(58) Field of Classification Search ..... 15/320, 15/321

See application file for complete search history.

(56) References Cited

U.S. PATENT DOCUMENTS 4,464,810 A * 8/1984 Karpanty ..... 15/320
4,956,891 A * 9/1990 Wulff ..... 15/320
5,640,738 A 6/1997 Williams et al. ..... 15/320
5,735,017 A 4/1998 Barnes et al. ..... 15/321
6,412,141 B2 7/2002 Kasper et al. ..... 15/320
6,609,268 B2 * 8/2003 Miner ..... 15/320
6,671,925 B2 * 1/2004 Field et al. ..... 15/320
6,880,199 B1 * 4/2005 Huffman et al. ..... 15/320

* cited by examiner

*Primary Examiner*—Theresa T. Snider
(74) *Attorney, Agent, or Firm*—A. Burgess Lowe; Brett A. Schenck

(57) ABSTRACT

A portable cleaning apparatus for cleaning a surface is provided and includes a housing. A distributor is operatively connected to the housing for distributing solution to the surface. A first solution container is mounted to the housing and contains a first solution. The first solution container has a bottom portion with an outlet portion fluidly connected to the distributor for supplying a flow of a first solution to the distributor. A second solution container with an outlet is provided in the first solution container and contains a second solution. The outlet of the second solution container is fluidly connected to the distributor for supplying a flow of a second solution to the distributor. In at least one aspect of the invention, the second solution container is design and constructed to transfer the weight of the first solution above the second solution container to the second solution in the second solution container to produce substantially the same hydrostatic head at both the outlet of the first solution container and the outlet of the second solution container.

21 Claims, 4 Drawing Sheets

SOLUTION DISTRIBUTION ARRANGEMENT FOR A CLEANING MACHINE

BACKGROUND OF THE INVENTION

1. Field of the Invention

The present invention relates to a solution distribution arrangement for a portable cleaning machine.

2. Background Information

It is known to have floor cleaning units that have a liquid distribution system for dispensing detergent to wash the floor and/or clean water to rinse the floor. Often when washing the floor, detergent from one supply tank is automatically mixed with clean water and then the mixed cleaning solution is distributed on the floor. It is desirable to maintain a constant mix ratio between the detergent and clean water, especially in a gravity flow system for its low cost benefits. However, as the level of the water and detergent lowers during the application of cleaning solution in a gravity flow system, the flow rates out of the tanks will decline and at disproportional rates from each other due to the different tank volumes. This is due to the different hydrostatic heads caused by the different levels of water and detergent in their respective tanks. These variable flow rates produces a variable mixing ratio. One solution is to pump the fluids from their respective tanks at a pressure that is much higher than the hydrostatic head, thus making the effect of the liquid level on flow rate insignificant. However, the pump is an added cost, consumes power, and is subject to failure.

It is an object of the present invention to provide a cleaning machine with clean water and detergent containers having a low cost and reliable automatic mixing system in which the mixing ratio of clean water and detergent is constant irrespective of the levels of clean water and detergent in their respective containers.

SUMMARY OF THE INVENTION

The foregoing and other objects of the present invention will be readily apparent from the following description and the attached drawings. In one aspect of the invention, a portable cleaning apparatus for cleaning a surface in which cleaning solution is dispensed to the surface and substantially simultaneously extracted along with the dirt on the surface in a continuous operation is provided. The portable cleaning apparatus includes a housing and a distributor operatively connected to the housing for distributing cleaning solution to the surface. A first solution container is removably mounted to the housing and fluidly connected to the distributor for supplying a flow of cleaning solution to the distributor. A recovery tank is removably mounted to the housing and a suction nozzle is secured to the housing and in fluid communication with the recovery tank for transporting the cleaning solution and dirt from the surface into the recovery tank. A suction source is in fluid communication with the suction nozzle and recovery tank for drawing the cleaning solution and dirt from the surface through the suction nozzle and to the recovery tank. A second solution container is provided inside the first solution container for supplying a flow of cleaning solution to the distributor.

In another aspect of the invention, a portable cleaning apparatus for cleaning a surface is provided and includes a housing. A distributor is operatively connected to the housing for distributing solution to the surface. A first solution container is mounted to the housing and contains a first solution. The first solution container has a bottom portion with an outlet portion fluidly connected to the distributor for supplying a flow of a first solution to the distributor. A second solution container is provided in the first solution container and contains a second solution. The second solution container has an outlet fluidly connected to the distributor for supplying a flow of a second solution to the distributor. The second solution container is design and constructed, to transfer the weight of the first solution above the second solution container to the second solution in the second solution container to produce substantially the same hydrostatic head at both the outlet of the first solution container and the outlet of the second solution container.

In still another aspect of the invention, a portable cleaning apparatus for cleaning a surface is provided and includes a housing. A distributor is operatively connected to the housing for distributing solution onto the surface. A first solution container having a bottom portion is mounted to the housing and fluidly connected to the distributor for supplying a flow of a first solution to the distributor. A second solution container is provided inside the first solution container for supplying a second solution to the distributor. The second solution container having a bottom portion, wherein the bottom portion of the second solution container having a fill opening for filling the second solution container with solution.

BRIEF DESCRIPTION OF THE DRAWINGS

The invention will now be described, by way of example, with reference to the attached drawings, of which.

DETAILED DESCRIPTION OF THE INVENTION

Figure 1:
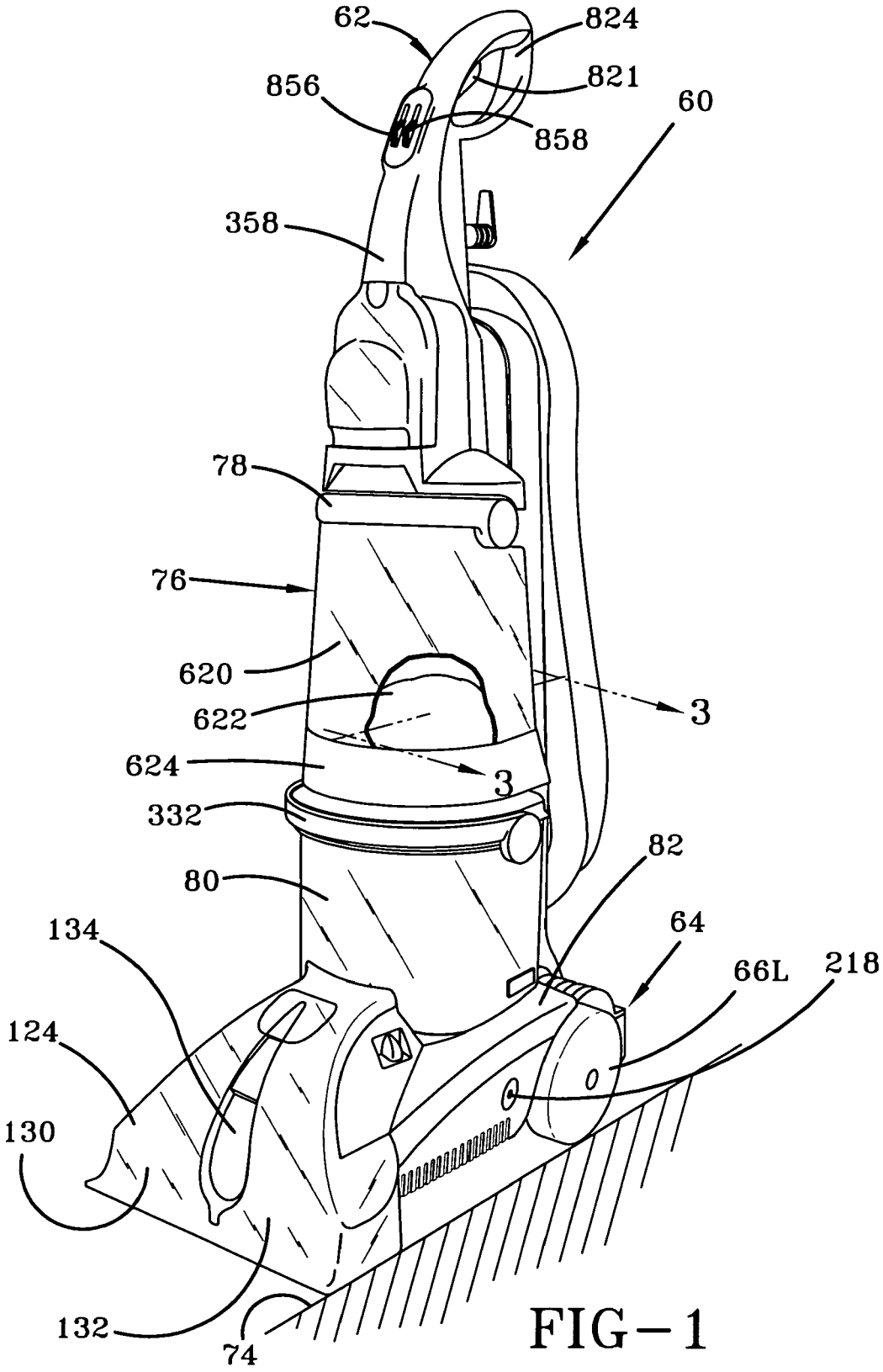
FIG. 1 is a perspective view of a carpet extractor embodying the present invention.

Referring to the drawings, FIG. 1 depicts a perspective view of a cleaning apparatus in the form of an upright carpet extractor 60 according to one embodiment of the present invention. The upright carpet extractor 60 comprises an upright handle assembly 62 pivotally connected to the rear portion of the floor-engaging portion of base assembly 64 that moves and cleans along a surface 74 such as a carpet. The base assembly 64 includes two laterally displaced wheels 66 (only the left wheel 66L being shown) rotatably attached thereto. A supply or solution tank assembly 76 is secured upon a bottom base 624 and removably mounted to the handle portion 62 of the extractor 60. A combined air/water separator and recovery tank 80 with carrying handle 332 removably sets atop a motor/fan assembly 90 (FIG. 3 from the copending published application having publication no. 20030226230, the disclosure being incorporated herein by reference) of base assembly 64 and is surrounded by a hood portion 82. A floor suction nozzle assembly 124 is removably mounted to the hood portion 82 of the base assembly 64 and in fluid communication with the recovery tank 80 for transporting air and liquid into the recovery tank 80. The floor suction nozzle assembly 124 includes a front plate secured to a rear plate that in combination define dual side ducts 130, 132 separated by a tear drop shaped opening 134.

Figure 2:
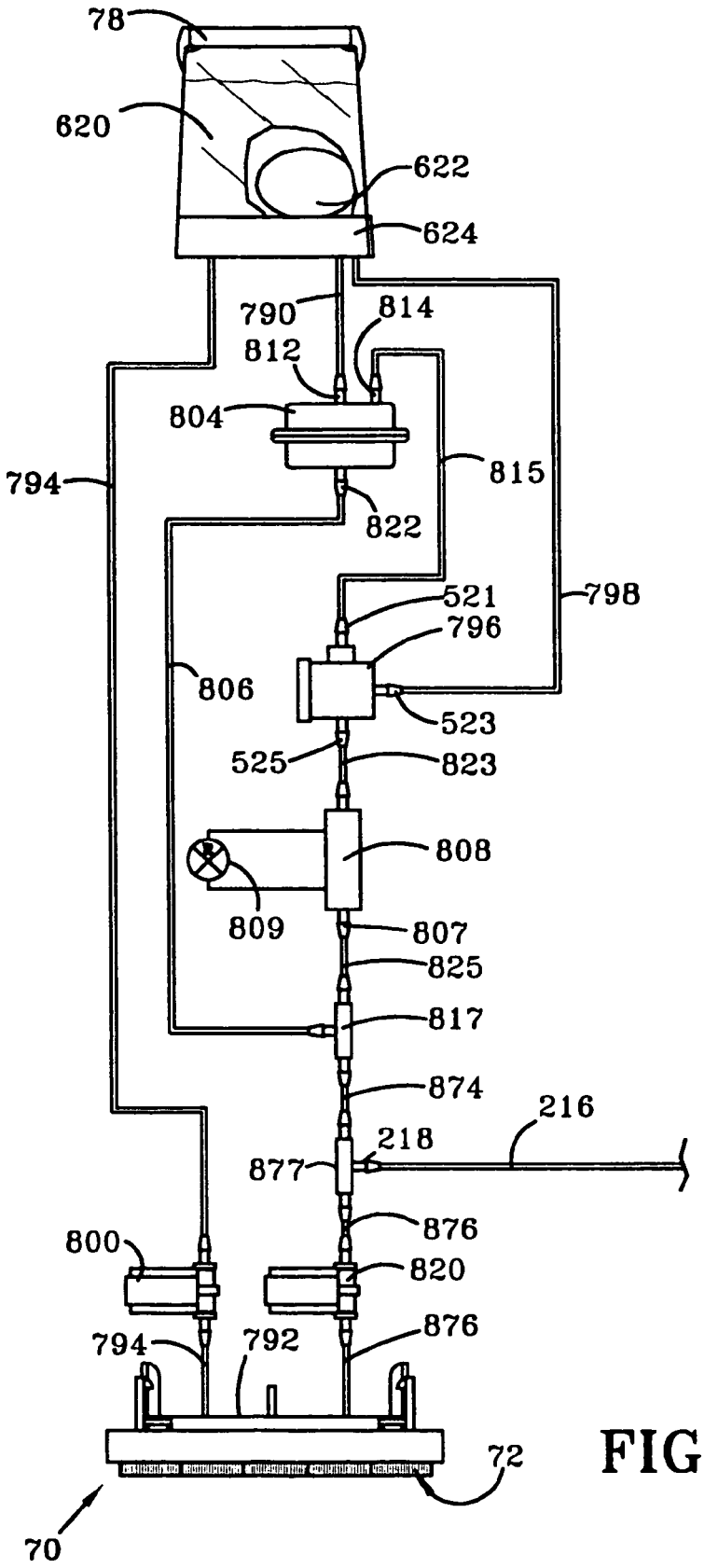
FIG. 2 is a schematic view of the fluid distribution system of the embodiment shown in FIG. 1 with portions broken away for illustrative purposes.

As depicted in FIG. 2, the base assembly 64 includes a brush assembly 70 having a plurality of rotating scrub brushes 72 for scrubbing the surface. A suitable brush assembly 70 is taught in U.S. Pat. No. 5,867,857, the disclosure which is incorporated herein by reference. Brush assembly 70 is operated by a suitable gear train (or other known means). A suitable air turbine driven gear train is taught in U.S. Pat. No. 5,443,362, the disclosure of which is incorporated by reference. Other brush assemblies could be used such as, for example, a horizontal brush roll or fixed brush assembly.

Figure 4:
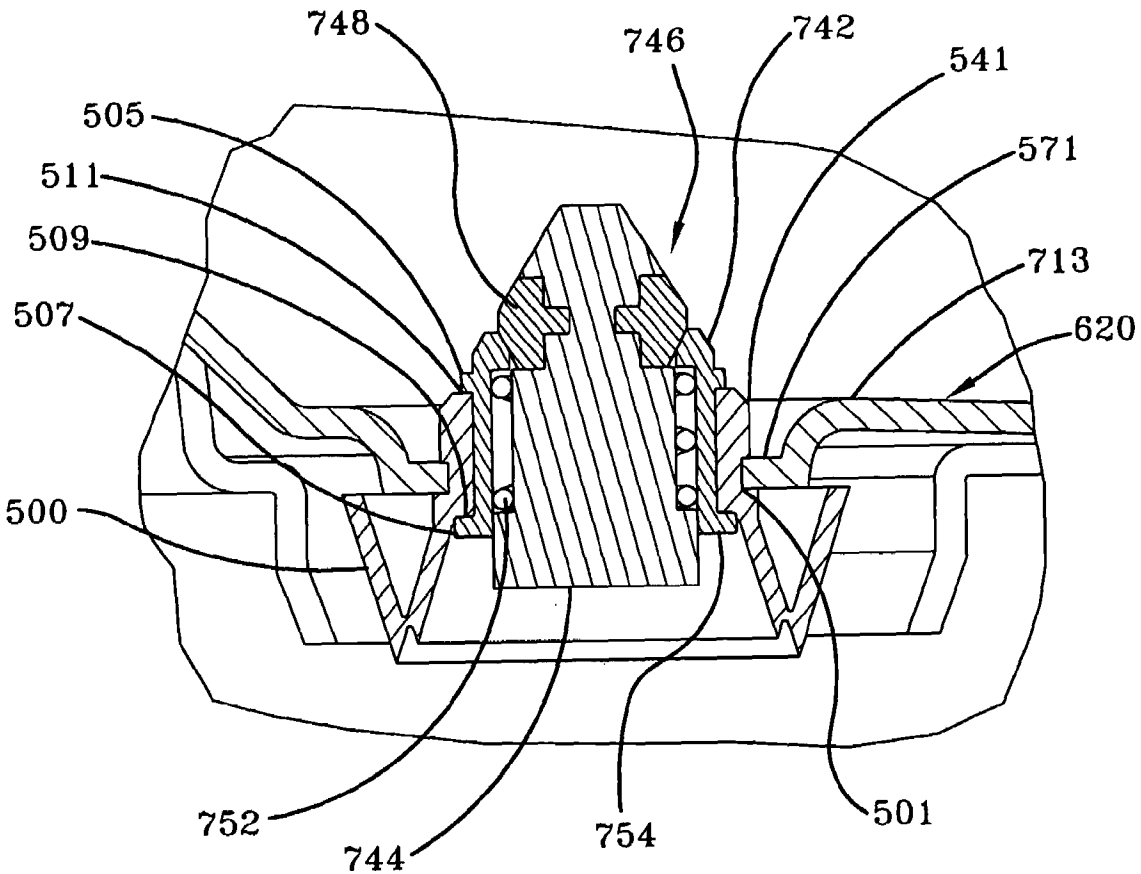
FIG. 4 is a vertical sectional view the solution release valve in the clean water tank.

The supply tank assembly 76 comprises a clean water supply tank 620 and a smaller detergent supply container 622 provided in the clean water supply tank 620 as depicted in FIG. 1. The supply tank assembly 76 includes a combination carrying handle and tank securement latch 78 providing a convenient means for carrying the tank and/or securing the tank to the extractor handle assembly 62. The clean water tank 620 has a cap 720 (FIG. 27 from co pending application having Ser. No. 10/165,731 and publication no. 20030226230) covering a top opening for filling the corresponding clean water tank 620 with clean water. The clean water tank 620 has a bottom wall 713 with an outlet opening 541, which receives a solution release valve 746 as seen in FIG. 4.

Figure 3:
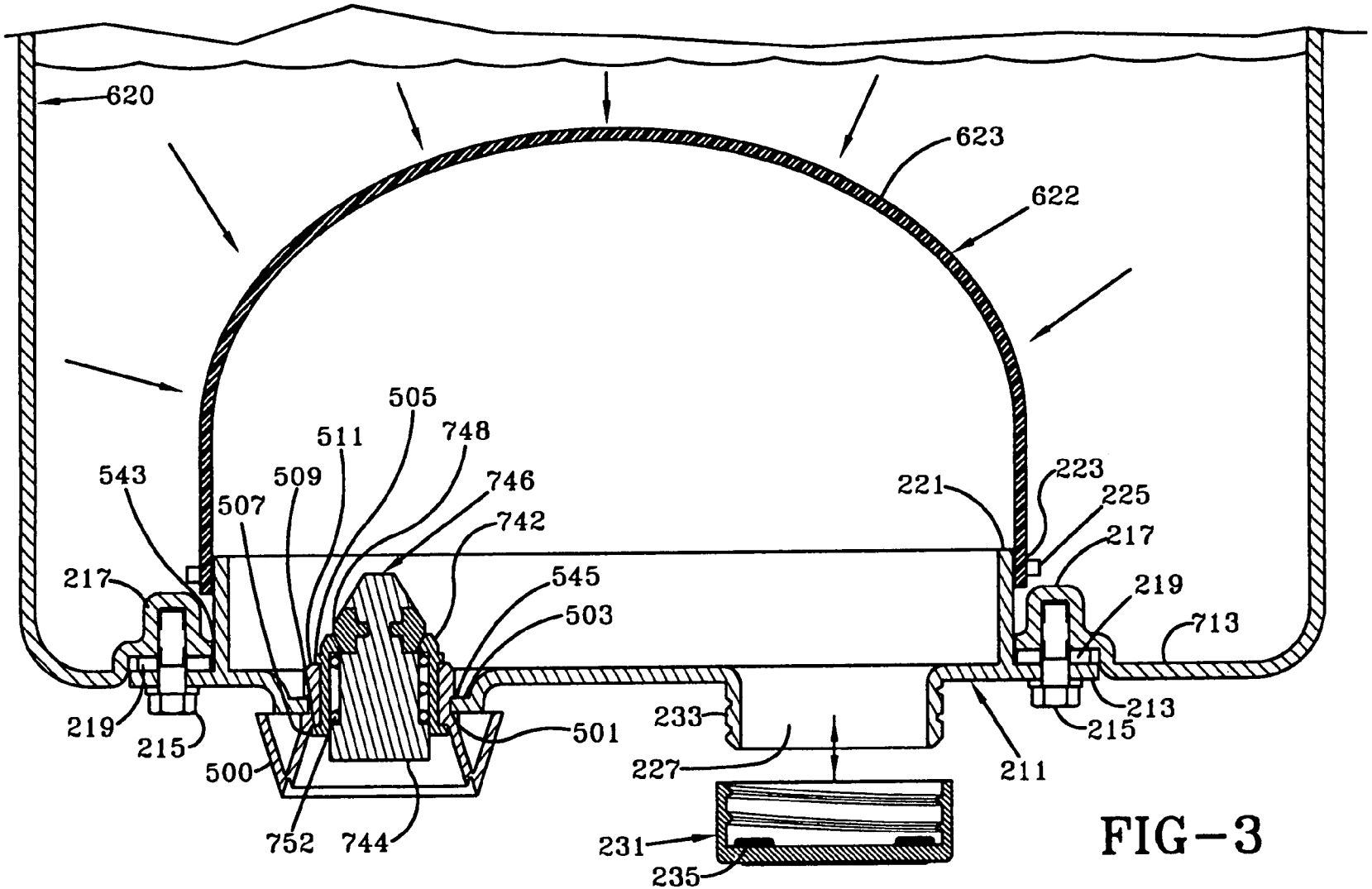
FIG. 3 is a sectional view of taken along line 3-3 of FIG. 1.

Referring to FIG. 3, the detergent container 622 is a flexible container in the form of a bladder. The material of the bladder is composed of vinyl that is chemical resistance to the detergent. However, other suitable flexible material can be used. A mounting member 211 is secured to the outer side of the bottom wall 713 and covers an opening 543 formed in the bottom wall 713 of the clean water tank 620. The mounting member 211 has a flat attaching portion 213 that is attached to the bottom wall 713 by a pair of screws 215 threaded into bosses 217 formed in the bottom wall 713. Seals 219 are inserted around the screws 215 and sandwiched between the mounting member 211 and bottom wall 713 to prevent the fluid in the clean water tank 620 from leaking. Other suitable means can be used to secure the mounting member 211 to the bottom wall 713, such as, for example, by adhesives or welding.

The mounting member 211 has a neck 221 extending upwardly therefrom over which a bottom neck 223 of the bladder 622 fits tightly around it and is adhesively secured. An elastic band or clamp 225 fits snugly around the neck 223 of a bladder for additional securement. The neck 221 surrounds a solution release valve 746 provided in the mounting member and a fill opening 227 formed in the mounting member 211 for filling the detergent container 622 with liquid detergent. A threaded cap 231 is removably secured to the fill opening 227. Alternatively, the neck 221 can be integrally formed with the bottom wall 713 of the clean water tank 620 with the outlet opening 545 and fill opening 227 being formed in the bottom wall 713 to eliminate the mounting member 211.

The solution release valve 746 is normally in the closed position. However, when the tank assembly 76 is positioned in the handle 62, the solution release valves 746 in the clean water tank 620 and detergent container 622 open permitting clean water from the clean water supply tank 620 and detergent from the detergent supply container 622 to flow to mixing Tee 796. Upon removal of the tank assembly 76 from the handle 62, the solution release valves 746 close prohibiting liquid from flowing out of the clean water tank 620 and detergent container 622.

As seen in FIG. 3, the solution release valve 746 is incorporated into the opening 545 of the mounting member 211 for the detergent container 622. The other solution release valve 746 is incorporated into outlet 541 of the bottom plate 713 of the clean water tank 620 as seen in FIG. 4, which is of similar construction. Thus, only the one for the detergent tank 622 will be described in more detail. The solution release valve 746 comprises a valve body 742 having an elongate plunger 744 extending coaxially upward there through. The plunger 744 having an outside diameter less than the inside diameter of the valve body 742 is provided with at least four flutes 745 (FIG. 27 from the copending published application having publication no. 20030226230) to maintain alignment of the plunger 744 within the valve body 742 as the plunger 744 axially translates therein and permits the passage of fluid there through when the plunger 744 is in the open position.

A valve body 742 having a vertically extending bore 756 (FIG. 27 from co pending application having Ser. No. 10/165,731 and publication no. 20030226230) slidingly receives therein the upper shank portion of the plunger 744. An elastomeric circumferential seal 748 circumscribes plunger 744 for sealingly engaging valve body 742. The seal 748 is urged against the valve body 742 by action of the compression spring 752, circumscribing plunger 744. The spring 752 is positioned between the body 742 and the seal 748. The solution release valve 746 is normally in the closed position. However, as the supply tank assembly 76 is placed upon the support shelf 743 of the handle 62, the pin 738 of the reservoir 721 (FIG. 27 from copending application having Ser. No. 10/165,731 and publication no. 20030226230) aligns with plunger 744, thereby forcing plunger 744 upward to separate the seal 748 from the valve body 742, compressing spring 752, and opening the valve body 742 permitting detergent from the detergent supply container 622 to flow through bore 756 of the valve body 742 into the reservoir 721. Upon removal of supply tank assembly 76 from the support shelf 743, the energy stored within compression spring 752 urges the seal 748 down against the valve body 742 to close the valve 746.

An elastomeric tank seal 500 has an annular groove 501 that receives the edge 503 of the opening 545 of the mounting member 211 to secure it to the edge 503. For the solution release valve 746 of the clean water tank 620, the tank seal 500 has the annular groove 501 receiving the edge 571 of the outlet opening 541 of the bottom wall 713 as seen in FIG. 4. Upper and lower annular ribs 505, 507 formed on the outer surface of the valve body 742 secure the elastomeric seal 500 to the valve body 742. In particular, the lower rib 507 engages the underside of a lip 509 on the seal and the upper rib extends over and engages the top edge 511 of the outlet opening. The cap 231 is threadily secured around a complimentary threaded downwardly depending neck portion 233 of the fill opening 227 of the mounting member 211. A seal 235 is sandwiched between the cap 231 and bottom end of the neck portion 233 to prevent fluid from leaking from the detergent container 622. Alternatively, the neck portion 233 can depend downwardly from the outlet opening 545, so that a threaded cap can be received thereon and also mount a solution release valve through the outlet opening 545 to eliminate the fill opening 227. Further details of such a cap and solution valve arrangement are shown in U.S. Pat. No. 6,167,586; the disclosure of which is hereby incorporated by reference.

In operation, the detergent container 622 is filled with liquid detergent and the clean water tank 620 is filled with the clean water above the height of the detergent. In this arrangement, the weight of the water above the detergent container or bladder is transferred through the bladder wail 623 to the liquid detergent. The bladder wall 623 is designed to be flexible enough to collapse and allow this weight transfer. The equal weight produces approximately the same hydrostatic head at both the outlet 541 for the water and outlet 545 for the liquid detergent. Also, as water level drops due to the clean water flowing out of the clean water tank 620, the pressures at each of the outlets changes by the same amount as long as the water level is above the detergent container 622. This constant pressure ratio in turn causes the flow rates to change at generally the same amount and thus substantially reduces the variation of the detergent to water mixing ratio in mixing Tee 796.

With continue reference to FIG. 2, the carpet extractor 60 includes a solution hose 794 that fluidly connects outlet opening 541 of the clean water tank 620 to a shut off valve 800 used for selectively turning on and off the flow of clean water. Another solution hose 790 fluidly connects the outlet opening 541 of the water tank 620 to an inlet 812 of a pressure actuated shut off valve 804. A solution hose 798 fluidly connects the outlet opening 545 of the detergent container 622 to an inlet 523 of the mixing Tee 796. A second shut off valve 820 is used for selectively turning on and off the flow of mixed water and detergent cleaning solution through distributor 792. Both shut off valves 800, 820 are fluidly connected to the distributor 792 through their respective solution hoses 794, 876. The shut off valves 800, 820 are in the form of solenoid valves, however, other types of valves also could be used.

The pressure actuated shut off valve 804 is fluidly connected between the clean water tank 620 and the mixing Tee 796 for turning off and on the flow of water. This shut off valve 804 is opened and closed by outside pressure via a conduit 806 connected between it and the outlet 807 of a pump 808 through a Tee 817. The valve 804 includes a pressure port 822 fluidly connected to the outlet 807 of a pump 808. The outlet of the valve 814 is fluidly connected to an inlet 521 of the mixing Tee 796 via hose 815. It should be known that clean water tank 620 could be fluidly connect to the outlet 814 of the valve 804 with the inlet 812 of the valve 804 being fluidly connect to the mixing Tee 796 so that fluid could flow the opposite direction if desired.

In operation, when the pressure at the pressure port 822 is below a predetermined value such as between 7 to 10 psi, the valve 804 opens to allow water to flow in both directions. Such a pressure value at the pressure port 822 occurs when the main shut off valve 820 is opened and the pump 808 is turned on. The pump 808 also pressurizes the water mixed with detergent to draw it to the distributor 792. When the pressure exceeds a second predetermined value such as between 20 to 30 psi, the valve 804 closes. This would occur if the main shut off valve 820 is closed and the pump is turned on. Thus, with the valve 804 closed, the cleaning solution is prevented from flowing through it. Various types of pumps can be used such as a piston pump, gear pump or centrifugal pump.

Outlet 525 of the mixing Tee 796 is fluidly connected via flexible hose 823 to the inlet of the pump 808, which provides pressure to draw the cleaning solution to the distributor 792, when it is turned on. A relief valve 809 is fluidly connected across the pump 808 to limit the pressure at the outlet 807 of the pump 808 to a predetermine value. The outlet 807 of the pump 808 is fluidly connected to the main shut off valve 820 via flexible hoses 825, 874 and 876.

The valves 800, 820 are operated by a trigger switch 821 as depicted in FIG. 1. The trigger switch 821 is pivotally connected to the upper handle portion 358 approximately near a closed looped handgrip 824. Slide switch 858 is used to select one of the shut off valves 800, 822 to be opened and closed by the trigger switch 821. Slide switch 856 is the main power switch, which turns on and off the suction motor 90 (FIG. 3 from copending application having Ser. No. 10/165,731 and publication no. 20030226230) and pump 808. The cleaning solution containing the clean water or water mixed with detergent flows to their associated shut off valves 800, 820. The cleaning liquid distributor 792 evenly distributes the cleaning solution to each of the rotary scrub brushes 72. The scrub brushes 72 then spread the cleaning solution onto the carpet (or bare floor), scrub the cleaning liquid into the carpet and dislodge embedded soil. A solution discharge valve 877 allows the mixed detergent and clean water to flow through an integrally formed nipple 218 and a detachable solution tube 216 to a hand-held cleaning attachment (not shown) and dispense by typical spray means.

As is commonly known, a user turns on the carpet extractor 60 and pivots the handle 62 in an incline position while moving the carpet extractor 60 over the surface to clean it. The user squeezes the trigger switch 821 so that the carpet extractor 60 distributes the cleaning solution to the surface and substantially simultaneously extracts it along with the dirt on surface in a continuous operation. In particular, soiled cleaning solution is extracted from the surface by the suction nozzle 124 and transported into the recovery tank 80 where the liquid and air are separated. A vacuum is created in the recovery tank 80 by the suction motor, which draws air from the recovery tank 80 and exhausts the air to the surface 74. Further details of the carpet extractor are disclosed in co pending application having Ser. No. 10/165,731 and publication no. 20030226230; the disclosure being incorporated herein by reference.

The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto. For example, the mixed detergent and clean water cleaning solution can flow from the clean water tank and detergent container by gravity alone, without the use of the pump, to the distributor.

In view of the above, it is intended that the present invention not be limited by the preceding disclosure of the embodiments, but rather be limited only by the appended claims.

What is claimed is:

1. A portable cleaning apparatus for cleaning a surface in which cleaning solution is dispensed to the surface and substantially simultaneously extracted along with any dirt on the surface in a continuous operation comprising;

a) housing;

b) a distributor operatively connected to said housing for distributing cleaning solution to said surface;

e) a first solution container removably mounted to said housing and fluidly connected to said distributor for supplying a first flow of cleaning solution to said distributor;

d) a recovery tank removably mounted to said housing;

e) a suction nozzle secured to said housing and in fluid communication with said recovery tank for transporting the cleaning solution and dirt from said surface into said recovery tank;

f) a suction source in fluid communication with said suction nozzle and recovery tank for drawing the cleaning solution and dirt from the surface through the suction nozzle and into the recovery tank; and g) second solution container provided inside said first solution container for supplying a second flow of cleaning solution to said distributor wherein the weight of the first cleaning solution within said first solution container acts on said second solution container.

2. The portable cleaning apparatus of claim 1 wherein said second solution container is a flexible bladder.

3. The portable cleaning apparatus of claim 1 wherein said first solution container has an outlet fluidly connected to said distributor, said second solution container having an outlet fluidly connected to said distributor, wherein said second solution container being designed and constructed to transfer the weight of the cleaning solution in said first solution container above said second solution container to the second solution to produce substantially the same hydrostatic head at both said outlet of said first solution container and said outlet of said second solution container.

4. The portable cleaning apparatus of claim 3 including a mixing chamber having a first inlet fluidly connected to said outlet of said first solution container and a second inlet fluidly connected to said outlet of said second solution container, said mixing chamber further having an outlet fluidly connected to said distributor, wherein the cleaning solutions from said first and second solution containers are mixed together in said mixing chamber whereby the mixing ratio of the cleaning solutions remains substantially constant as the level of the cleaning solution in said first solution container lowers due to the flow of the cleaning solution out of the first solution container.

5. The portable cleaning apparatus of claim 1 wherein said second solution container has a bottom portion, said bottom portion of said second solution container having a fill opening for filling said second solution container with cleaning solution.

6. The portable cleaning apparatus of claim 5 including a solution release valve operatively connected to said bottom portion of said second solution container and said distributor, said solution release valve being closed to prevent cleaning solution from said second solution container from flowing to said distributor when said second solution container is removed from said housing.

7. The portable cleaning apparatus of claim 1 including a solution release valve operatively connected to a bottom portion of said second solution container and said distributor, said solution release valve being closed to prevent cleaning solution from said second solution container from flowing to said distributor when said second solution container is removed from said housing.

8. The portable cleaning apparatus of claim 1 wherein said housing comprises a base for movement along the surface and a handle pivotally connected to said base, said first solution container being removably mounted to one of said base and said handle.

9. A portable cleaning apparatus for cleaning a surface comprising:

a) a housing;

b) a distributor operatively connected to said housing for distributing solution to said surface;

c) a first solution container mounted to said housing and containing a first solution, said first solution container having a bottom portion with an outlet fluidly connected to said distributor for supplying a flow of said first solution to said distributor;

d) a second solution container provided in said first solution container and containing a second solution, said second solution container having an outlet being fluidly connected to said distributor for supplying a flow of said second solution to said distributor; and wherein said second solution container being designed and constructed to transfer the weight of the first solution above said second solution container to the second solution in said second solution container to produce substantially the same hydrostatic head at both said outlet of said first solution container and said outlet of said second solution container.

10. The portable cleaning apparatus of claim 9 including a mixing chamber having a first inlet fluidly connected to said outlet of said first solution container and a second inlet fluidly connected to said outlet of said second solution container, said mixing chamber further having an outlet fluidly connected to said distributor, wherein the solutions from said first and second solution containers are mixed together in said mixing chamber whereby the mixing ratio of the first and second solutions remains substantially constant as the level of the first solution in said first solution container lowers due to the flow of the first solution out of the first solution container.

11. The portable cleaning apparatus of claim 9 wherein said second solution container is a flexible bladder.

12. The portable cleaning apparatus of claim 9 wherein said second solution container has a bottom portion, said bottom portion of said second solution container having a fill opening for filling said second solution container with the second solution.

13. The portable cleaning apparatus of claim 12 including a solution release valve operatively connected to said bottom portion of said second solution container and said distributor, said solution release valve being closed to prevent the second solution from said second solution container from flowing to said distributor when said second solution container is removed from said housing.

14. The portable cleaning apparatus of claim 9 including a solution release valve operatively connected to a bottom portion of said second solution container and said distributor, said solution release valve being closed to prevent the second solution from said second solution container from flowing to said distributor when said second container is removed from said housing.

15. A portable cleaning apparatus for cleaning a surface comprising:

a) a housing;

b) a distributor operatively connected to said housing for distributing solution onto the surface;

c) a first solution container mounted to said housing and fluidly connected to said distributor for supplying a flow of a first solution to said distributor, said first solution container having a bottom portion; and d) a second solution container provided inside said first solution container for supplying a second solution to said distributor wherein the weight of the first solution within said first solution container acts on said second solution container, said second solution container having a bottom portion, wherein said bottom portion of said second solution container having a fill opening for filling said second solution container with said second solution.

16. The portable cleaning apparatus of claim 15 including a solution release valve operatively connected to said bottom portion of said second solution container and said distributor, said solution release valve being closed to prevent the second solution from said second solution container from flowing to said distributor when said second solution container is removed from said housing.

17. The portable cleaning apparatus of claim 15 including a mounting member mounted to said bottom portion of said second solution container and said first solution container, said fill opening being disposed in said mounting member.

18. The portable cleaning apparatus of claim 17 including a solution release valve operatively connected to said mounting member and said distributor, said solution release valve being closed to prevent the second solution from said second solution container from flowing to said distributor when said second solution container is removed from said housing.

19. The portable cleaning apparatus of claim 18 wherein said solution release valve is provided in an opening formed in said mounting member and spaced from said fill opening.

20. The portable cleaning apparatus of claim 15 wherein fill opening is disposed in said bottom portion of said first solution container.

21. The portable cleaning apparatus of claim 20 including a solution release valve operatively connected to said bottom portion of said first solution container and said distributor, said solution release valve being closed to prevent the second solution from said second solution container from flowing to said distributor when said second solution container is removed from said housing.

* * * * *